US010004279B2

(12) United States Patent
Carlton

(10) Patent No.: US 10,004,279 B2
(45) Date of Patent: Jun. 26, 2018

(54) WRAP-STYLE BREAST-SUPPORTIVE TOPS

(71) Applicant: Michell Carlton, Portland, OR (US)

(72) Inventor: Michell Carlton, Portland, OR (US)

( * ) Notice: Subject to any disclaimer, the term of this patent is extended or adjusted under 35 U.S.C. 154(b) by 0 days. days.

(21) Appl. No.: 15/666,239

(22) Filed: Aug. 1, 2017

(65) Prior Publication Data

US 2018/0035725 A1 Feb. 8, 2018

Related U.S. Application Data

(60) Provisional application No. 62/370,370, filed on Aug. 3, 2016.

(51) Int. Cl.

| | |
|---|---|
| ***A41C 3/08*** | (2006.01) |
| ***A41D 7/00*** | (2006.01) |
| ***A41D 10/00*** | (2006.01) |
| ***A41D 13/00*** | (2006.01) |
| *A41D 1/22* | (2018.01) |

(52) U.S. Cl.

CPC ..... *A41C 3/08* (2013.01); *A41D 7/00* (2013.01); *A41D 10/00* (2013.01); *A41D 13/0017* (2013.01); *A41B 2300/322* (2013.01); *A41D 1/22* (2013.01)

(58) Field of Classification Search

CPC ..... A41C 3/00; A41C 3/0014; A41C 3/02; A41C 3/08; A41B 1/06; A41D 1/04; A41D 13/12; A41D 13/1245; A41D 13/1209

USPC ... 450/7–11, 4, 5, 14–17, 23, 26, 28, 30–33, 450/79; 128/874, 873, 869

See application file for complete search history.

(56) References Cited

U.S. PATENT DOCUMENTS

| | | | | | |
|---|---|---|---|---|---|
| 1,164,642 | A | * | 12/1915 | Guinzburg | A41C 3/08 2/54 |
| 1,362,027 | A | * | 12/1920 | Miller | A41C 3/00 450/79 |
| 1,454,790 | A | * | 5/1923 | Rothkowitz | A41C 3/00 450/77 |
| 1,545,441 | A | * | 7/1925 | Newman | A41C 3/00 450/4 |
| 2,152,629 | A | * | 4/1939 | Gluckin | A41C 3/00 450/59 |
| 2,372,855 | A | * | 4/1945 | Reid | A41C 3/00 450/59 |
| 2,433,820 | A | * | 12/1947 | Tarbell | A41B 9/06 2/73 |
| 2,918,677 | A | * | 12/1959 | Pindyck | A41B 9/06 2/111 |
| 4,440,174 | A | * | 4/1984 | Cordova | A41C 3/08 2/67 |
| 5,060,648 | A | * | 10/1991 | Zarkesh | A61F 7/10 450/79 |

(Continued)

*Primary Examiner* — Katharine Gracz

(74) *Attorney, Agent, or Firm* — DASCENZO Intellectual Property Law, P.C.

(57) ABSTRACT

Wrap-style breast-supportive tops comprise an outer fabric layer, an inner fabric layer coupled to the outer fabric layer and positioned to be between the outer fabric layer and a wearer when the wearer is wearing the wrap-style breast-supportive top, and a fastening system. The top is either a right-side out top or a left-side out top, with the fastening system configured to secure a left edge of the inner fabric layer adjacent to the right side of the wearer's upper torso and a right edge of the inner fabric layer adjacent to the left side of the wearer's upper torso.

20 Claims, 6 Drawing Sheets

(56) References Cited

U.S. PATENT DOCUMENTS

| | | | | | |
|---|---|---|---|---|---|
| 5,267,352 | A * | 12/1993 | Rodarmel | A41D 13/1245 | 128/846 |
| 5,378,192 | A * | 1/1995 | Darmante | A41C 3/0028 | 2/106 |
| 6,068,538 | A * | 5/2000 | Alleyne | A41C 3/0057 | 450/1 |
| 8,172,639 | B2 * | 5/2012 | Swendseid | A41C 3/0028 | 450/85 |
| 8,460,054 | B2 | 6/2013 | Swendseid | | |
| D738,068 | S * | 9/2015 | Boland | D2/720 | |
| 2004/0166766 | A1 * | 8/2004 | Schneider | A41C 3/04 | 450/36 |
| 2005/0085160 | A1 * | 4/2005 | Johnstone | A41C 3/04 | 450/36 |
| 2007/0271675 | A1 * | 11/2007 | Eraca | A41D 1/205 | 2/104 |
| 2008/0229474 | A1 * | 9/2008 | Fons | A41B 9/08 | 2/113 |
| 2014/0031775 | A1 * | 1/2014 | Criss | A61F 5/4408 | 604/355 |

* cited by examiner

WRAP-STYLE BREAST-SUPPORTIVE TOPS

RELATED APPLICATION

This application claims priority to U.S. Provisional Patent Application No. 62/370,370, entitled WRAP-STYLE BREAST-SUPPORTIVE TOPS, which was filed on Aug. 3, 2016, and the complete disclosure of which is incorporated herein by reference.

FIELD

The present disclosure relates to garments.

BACKGROUND

In 1985, the average chest/breast size was 34B. Today, it is 34DD. In other words, while breast sizes appears to be increasing, chest sizes are not, and the antiquated sizing and construction of tops, and in particular casual tops, have not been improved to meet the needs of larger breasts. Accordingly, larger breasted women are often left with few or undesirable options. Existing wrap-style casual tops, which provide a desired aesthetic, do not provide the necessary breast support without wearing a separate structured bra. In addition, existing casual tops, including wrap-style casual tops, often include narrow shoulder straps that are uncomfortable for wearers with large breasts. Moreover, large-breasted individuals may find it difficult or uncomfortable to pull on existing bra solutions, such as shelf bras and sports bras, that have fitted elastic bands without clasps.

SUMMARY

Wrap-style breast-supportive tops according to the present disclosure comprise an outer fabric layer, an inner fabric layer coupled to the outer fabric layer, and a fastening system. The outer fabric layer has an outer left portion, an outer right portion, an outer central portion that is positioned between the outer left portion and the outer right portion, an outer upper edge, an outer left edge, an outer right edge, an outer lower edge, an outer left interface between the outer left portion and the outer central portion, and an outer right interface between the outer right portion and the outer central portion. The inner fabric layer is positioned to be between the outer fabric layer and a wearer when the wearer is wearing the wrap-style breast-supportive top. The inner fabric layer has an inner left portion that overlaps an upper region of the outer left portion to collectively define a left-side front section, an inner right portion that overlaps an upper region of the outer right portion to collectively define a right-side front section, an inner central portion that is positioned between the inner left portion and the inner right portion and that overlaps an upper region of the outer central portion to collectively define a back section, an inner upper edge that is coupled (e.g., sewn) to the outer upper edge, an inner left edge that is coupled (e.g., sewn) to the outer left edge, an inner right edge that is coupled (e.g., sewn) to the outer right edge, an inner lower edge, an inner left interface between the inner left portion and the inner central portion, and an inner right interface between the inner right portion and the inner central portion. The left-side front section and the back section collectively define a left armscye or a left arm hole along the outer left interface and the inner left interface, and the right-side front section and the back section collectively define a right armscye or a right arm hole along the outer right interface and the inner right interface. The fastening system comprises at least one right edge fastener coupled (e.g., sewn) to the right-side front section along the inner right edge and/or the outer right edge, at least one left interface fastener coupled (e.g., sewn) to the outer fabric layer and/or the inner fabric layer along the outer left interface and/or the inner left interface and configured to be selectively coupled to and decoupled from the at least one right edge fastener, at least one left edge fastener coupled (e.g., sewn) to the left-side front section along the inner left edge and/or the outer left edge, and at least one right interface fastener coupled (e.g., sewn) to the outer fabric layer and/or the inner fabric layer along the outer right interface and/or the inner right interface and configured to be selectively coupled to and decoupled from the at least one left edge fastener.

DESCRIPTION

Figure 1:
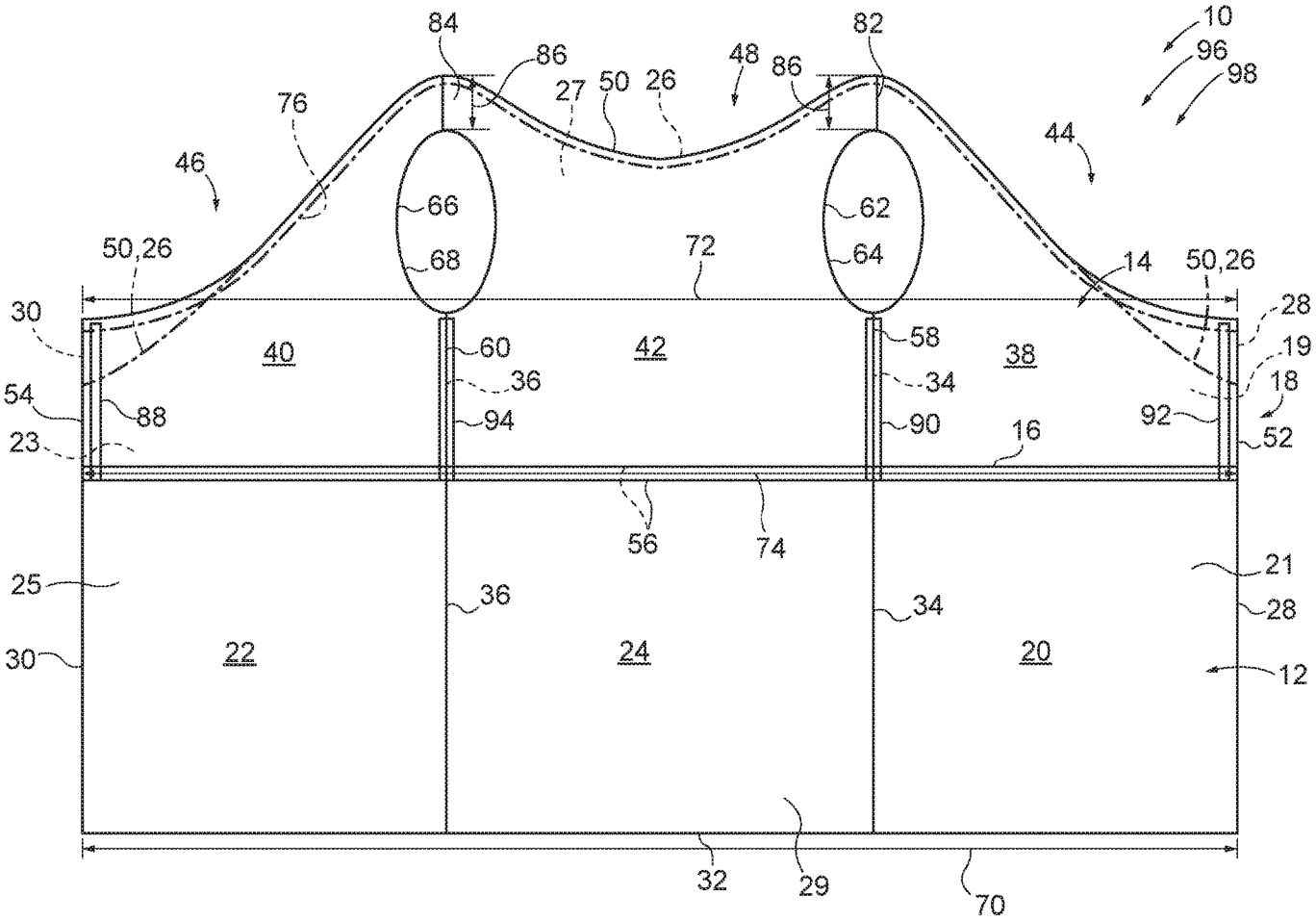
FIG. 1 is a schematic illustration representing wrap-style breast-supportive tops according to the present disclosure.

Wrap-style breast-supportive tops 10 are disclosed herein and are schematically represented in FIG. 1 in a flat, or spread open, configuration revealing the inside of the wrap-style breast-supportive tops 10, that is, the side that faces a wearer's body when worn. FIG. 1 is schematic in nature and is not intended to represent exact shapes of wrap-style breast-supportive tops 10 and component parts and portions thereof. Wrap-style breast-supportive tops 10 also may be referred to herein simply as tops 10. Tops 10 may be configured for any suitable application, including (but not limited to) casual wear, sleep wear, swim wear, yoga wear, light athletic wear, etc. As used herein, left, right, upper, lower, inner, outer, and other relative terms of position relate to a top 10 from the perspective of a wearer when standing upright and wearing the top 10. In FIG. 1, dashed lead lines are used in connection with hidden elements, and dash-dot lines are used to illustrate elements that may be optional to a given example of top 10. However, elements that are illustrated in solid lines are not essential to all examples of the present disclosure, and an element shown in solid lines may be omitted from a particular example without departing from the scope of the present disclosure.

As schematically represented in FIG. 1, tops 10 comprise at least an outer fabric layer 12, an inner fabric layer 14, an elastic band 16, and a fastening system 18. The inner fabric layer 14 is positioned to be between the outer fabric layer 12 and the wearer when a top 10 is worn. Accordingly, in FIG. 1, the inner fabric layer 14 is shown above, or atop, the outer fabric layer 12. The outer fabric layer 12 and the inner fabric layer 14 may be constructed of any suitable material. In some examples of tops 10, the outer fabric later 12 and the inner fabric layer 14 are constructed of the same material. In other examples of tops 10, the outer fabric layer and the inner fabric layer are constructed of different materials. In some examples of tops 10, it may be desirable for one or both of the outer fabric layer 12 and the inner fabric layer 14 to be constructed of a material having approximately 40-60% or 45-55% stretch with complete, or nearly complete, recovery. In some examples, ponte knit fabric may be a suitable material, but other materials are within the scope of the present disclosure, including (but not limited to) swim material, heavy-gauge swim material, cotton, heavy-gauge stretch cotton, polyester, performance polyester, and medium-heavy gauge performance polyester.

The outer fabric layer 12 has an outer left portion 20, an outer right portion 22, and an outer central portion 24 that is positioned between the outer left portion 20 and the outer right portion 22. In some examples of top 10, the outer left portion 20, the outer right portion 22, and the outer central portion 24 are constructed of discrete panels of fabric that are coupled together, such as sewn together, and therefore they may be described respectively as an outer left panel 20, an outer right panel 22, and an outer central panel 24. In some such examples of top 10, one or more of the outer left panel 20, the outer right panel 22, and the outer central panel 24, itself may be constructed of two discrete panels, including an upper panel and a lower panel. For example, as schematically represented in FIG. 1, the outer left panel 20 may be constructed of an upper outer left panel 19 and a lower outer left panel 21 that are coupled (e.g., sewn) together, the outer right panel 22 may be constructed of an upper outer right panel 23 and a lower outer right panel 25 that are coupled (e.g., sewn) together, and/or the outer central panel 24 may be constructed of an upper outer central panel 27 and a lower outer central panel 29 that are coupled (e.g., sewn) together. In yet other examples of top 10, two or more of the outer left portion 20, the outer right portion 22, and the outer central portion 24 may be constructed of a single panel of fabric.

The outer fabric layer 12 also has an outer upper edge 26, an outer left edge 28, an outer right edge 30, an outer lower edge 32, an outer left interface 34 between the outer left portion 20 and the outer central portion 24, and an outer right interface 36 between the outer right portion 22 and the outer central portion 24. In examples of top 10 in which the outer left portion 20, the outer right portion 22, and the outer central portion 24 are constructed of discrete panels of fabric, the outer left interface 34 and the outer right interface 36 may coincide with and/or be defined by corresponding seams between the adjacent panels. Interfaces between two adjacent portions additionally or alternatively may be described as boundaries between two adjacent portions and are not necessarily defined by a distinct structure, such as a seam, for example, when adjacent portions are not constructed of discrete panels.

Similarly, the inner fabric layer 14 has an inner left portion 38, an inner right portion 40, and an inner central portion 42 that is positioned between the inner left portion 38 and the inner right portion 40. In some examples of top 10, the inner left portion 38, the inner right portion 40, and the inner central portion 42 are constructed of discrete panels of fabric that are coupled together, such as sewn together, and therefore that may be described respectively as an inner left panel 38, an inner right panel 40, and an inner central panel 42. In other examples of top 10, the inner left portion 38, the inner right portion 40, and the inner central portion 42 are constructed of a single panel of fabric.

As schematically represented in FIG. 1, the inner left portion 38 overlaps an upper region of the outer left portion 20 to collectively define a left-side front section 44, the inner right portion 40 overlaps an upper region of the outer right portion 22 to collectively define a right-side front section 46, and the inner central portion 42 overlaps an upper region of the outer central portion 24 to collectively define a back section 48. In addition, the inner fabric layer 14 has an inner upper edge 50 that is coupled (e.g., sewn) to the outer upper edge 26, an inner left edge 52 that is coupled (e.g., sewn) to the outer left edge 28, an inner right edge 54 that is coupled (e.g., sewn) to the outer right edge 30, an inner lower edge 56, an inner left interface 58 between the inner left portion 38 and the inner central portion 42, and an inner right interface 60 between the inner right portion 40 and the inner central portion 42. In some examples of top 10, the outer left interface 34 and the inner left interface 58 are coupled (e.g., sewn) together, and the outer right interface 36 and the inner right interface 60 are coupled (e.g., sewn) together.

Accordingly, as schematically represented in FIG. 1, generally in tops 10, the inner fabric layer 14 is coextensive with at least an upper region of the outer fabric layer 12, with the inner upper edge 50 being coextensive, or aligned, with the outer upper edge 26, with the inner left edge 52 being coextensive, or aligned, with an upper region of the outer left edge 28, with the inner right edge 54 being coextensive, or aligned, with an upper region of the outer right edge 30, with the inner left interface 58 being coextensive, or aligned, with an upper region of the outer left interface 34, and with the inner right interface 60 being coextensive, or aligned, with an upper region of the outer right interface 36.

In some examples of top 10, as schematically represented in FIG. 1, the outer left edge 28 is longer than the inner left edge 52, the outer right edge 30 is longer than the inner right edge 54, the outer left interface 34 is longer than the inner left interface 58, and the outer right interface 36 is longer than the inner right interface 60, such that the outer fabric layer 12 extends below the inner fabric layer 14 and such that the inner lower edge 56 is not coextensive with the outer lower edge 32, such as to cover the lower torso and abdomen of a wearer when such a top 10 is worn. In some such examples of top 10, the outer left edge 28 is at least twice as long as the inner left edge 52, and the outer right edge 30 is at least twice as long as the inner right edge 54. In some such examples, the top 10 may define, be incorporated into, or otherwise be worn as a dress, with the outer fabric layer 12 extending below the lower torso and abdomen of a wearer. Also in some such examples of top 10, the inner lower edge 56 is coupled (e.g., sewn) to the outer fabric layer 12 along a full length of the inner lower edge 56. In other such examples of top 10, the inner lower edge 56 is coupled (e.g., sewn) to the outer fabric layer 12 along only the outer left portion 20 and the outer right portion 22, that is, not along the outer central portion 24. In yet other examples of top 10, the inner lower edge 56 is not coupled (e.g., sewn) to the outer fabric layer 12 other than at the outer left edge 28 and the outer right edge 30. In yet other examples of top 10, the inner lower edge 56 is not coupled (e.g., sewn) to the outer fabric layer other than at the outer left edge 28, the outer right edge 30, the outer left interface 34, and the inner left interface 58.

In other examples of top 10, the outer left edge 28 is not longer than the inner left edge 52, the outer right edge 30 is not longer than the inner right edge 54, the outer left interface 34 is not longer than the inner left interface 58, and the outer right interface 36 is not longer than the inner right interface 60, such that the outer fabric layer 12 does not extend below the inner fabric layer 14. In some such examples, the outer left edge 28 is the same (or approximately the same) length as the inner left edge 52, the outer right edge 30 is the same (or approximately the same) length as the inner right edge 54, the outer left interface 34 is the same (or approximately the same) length as the inner left interface 58, and the outer right interface 36 is the same (or approximately the same) length as the inner right interface 60, such that the inner lower edge 56 is coextensive with the outer lower edge 32. In some such examples of top 10, the inner lower edge 56 may be coupled (e.g., sewn) to the outer lower edge 32. Such tops 10 optionally may be referred to as, or described as, swimsuit tops, crop tops, bras, shelf bras, or sports bras.

In some examples of top 10, as schematically illustrated in solid lines in FIG. 1, the inner left edge 52 and the inner right edge 54 are substantially the same height as the inner left interface 58 and the inner right interface 60, such that when the top 10 is operatively donned, as discussed herein, the inner left edge 52 becomes generally coextensive with the inner right interface 60, and the inner right edge 54 becomes generally coextensive with the inner left interface 58. In other examples of top 10, as schematically illustrated in dash-dot lines in FIG. 1, the heights of the inner left edge 52 and the inner right edge 54 may be less than the heights of the inner left interface 58 and the inner right interface 60, such that when the top 10 is operatively donned, as discussed herein, the inner left edge 52 is generally aligned with but is not fully coextensive with the inner right interface 60, and the inner right edge 54 is aligned with but is not fully coextensive with the inner left interface 58.

When two components are described as being "coextensive" or "generally coextensive" herein, it is not meant that the two components necessarily have identical lengths or spans or necessarily are precisely aligned with each other. As known in the art, garment construction is not perfect, with allowances utilized for seams and hems and with both human alignment and machine alignment not being perfect, for example, when sewing two fabric panels together.

The elastic band 16 is coupled (e.g., sewn) to the inner fabric layer 14 along the inner lower edge 56. In some examples, the elastic band 16 is coupled (e.g., sewn) to the inner fabric layer 14 along one or both of the lower edge and the upper edge of the elastic band 16. In some examples of top 10, the elastic band 16 spans an entire width of the inner fabric layer 14 along the inner lower edge 56. In some examples of top 10, the elastic band 16 is not, however, coupled (e.g., sewn) directly to the outer fabric layer 12 other than optionally at one or more of the outer left interface 34, the outer right interface 36, the outer left edge 28, and the outer right edge 30, such as in connection with the optional examples discussed above. The elastic band 16 secures the inner lower edge 56 of the inner fabric layer 14 against a wearer's body when the top 10 is donned. The inner fabric layer 14 thereby provides support to the wearer's breasts when the top 10 is sized properly and donned by the wearer. The inner fabric layer 14 therefore may be described as an integral shelf bra of tops 10.

The outer fabric layer 12 may be described as having a maximum outer width 70 that extends from the outer left edge 28 to the outer right edge 30. The inner fabric layer 14 may be described as having a maximum inner width 72 that extends from the inner left edge 52 to the inner right edge 54. More specifically, the maximum inner width 72 may be defined without the elastic band 16 imparting a change in width to the inner fabric layer 14, such as without the elastic band coupled to the inner fabric layer 14 and/or with the elastic band 16 stretched so that the inner fabric layer 14 lays flat and is not scrunched by the elastic band 16. The elastic band 16 or the inner lower edge 56 may have a relaxed length 74 when no tension is applied to the elastic band 16. In some examples of top 10, the maximum outer width 70 is equal to, or approximately equal to, the maximum inner width 72. In some examples of top 10, the relaxed length 74 is less than the maximum outer width 70, such as with the relaxed length 74 being one or more of 50-90%, 60-90%, and 70-90% of the maximum outer width 70. Similarly, in some examples of top 10, the relaxed length 74 is less than the maximum inner width 72, such as with the relaxed length 74 being one or more of 50-90%, 60-90%, and 70-90% of the maximum inner width 72.

In addition to or as an alternative to comprising the elastic band 16, some tops 10 may be constructed with one or more of the inner left portion 38, the inner right portion 40, and the inner central portion 42 (or sub-regions thereof) itself being constructed of an elastic, or other resilient or stretchable, material. In such examples of top 10, the inner fabric layer 14 may provide the requisite support to a wearer's breasts when the top 10 is donned.

The left-side front section 44 and the back section 48 collectively define a left armscye 62 or a left arm hole 64 along, within, or formed through the outer left interface 34 and the inner left interface 58, and the right-side front section 46 and the back section 48 collectively define a right armscye 66 or a right arm hole 68 along, within, or formed through the outer right interface 36 and the inner right interface 60. Armscyes 62, 66 or arm holes 64, 68, when present, are sized and shaped to receive a wearer's respective left and right arms therethrough. Examples of tops 10 that include armscyes 62, 66 additionally include sleeves coupled (e.g., sewn) to the armscyes and may be described as sleeved tops 10. Examples of tops 10 that include arm holes 64, 68 do not include sleeves and may be described as sleeveless tops 10 or tank tops 10.

In some examples of top 10, including examples with arm holes 64, 68, the outer fabric layer 12 and the inner fabric layer 14 may be described as collectively defining a left shoulder strap 82 and a right shoulder strap 84 that extend atop, or over, the wearer's shoulders when the wearer is wearing the top 10. In some such examples of top 10, the left shoulder strap 82 and the right shoulder strap 84 each have a minimum width 86 of no less than 1, 1.5, 2, 3, or 5 inches and/or a maximum width of no more than 7, 5, 3, or 2 inches. By having such minimum widths, the shoulder straps comfortably support the weight of a wearer's breasts on the wearer's shoulders. In some examples, the left shoulder strap 82 and/or right shoulder strap 84 may extend laterally over an edge of the wearer's shoulders, thereby providing a cap sleeve top 10.

As schematically represented in FIG. 1, the fastening system 18 comprises at least one (optionally two or more) right edge fastener 88, at least one (optionally two or more) left interface fastener 90 corresponding to and configured to mate with the at least one right edge fastener 88, at least one (optionally two or more) left edge fastener 92, and at least one (optionally two or more) right interface fastener 94 corresponding to and configured to mate with the at least one left edge fastener 92. The at least one right edge fastener 88 and the at least one left interface fastener 90 may be described as a fastener pair, and the at least one left edge fastener 92 and the at least one right interface fastener 94 may be described as a fastener pair.

The at least one right edge fastener 88 is coupled (e.g., sewn) to the right-side front section 46 along the inner right edge 54 and/or the outer right edge 30. The at least one left interface fastener 90 is coupled (e.g., sewn) to the outer fabric layer 12 and/or the inner fabric layer 14 along the outer left interface 34 and/or the inner left interface 58. The at least one left interface fastener 90 is configured to be selectively coupled to and decoupled from the at least one right edge fastener 88.

The at least one left edge fastener 92 is coupled (e.g., sewn) to the left-side front section 44 along the inner left edge 52 and/or the outer left edge 28. The at least one right interface fastener 94 is coupled (e.g., sewn) to the outer fabric layer 12 and/or the inner fabric layer 14 along the outer right interface 36 and/or the inner right interface 60. The at least one right interface fastener 94 is configured to be selectively coupled to and decoupled from the at least one left edge fastener 92.

In FIG. 1, the fasteners are represented as boxes, schematically representing one or more such fasteners of any suitable configuration or type and schematically representing placement of the respective fastener on the inside or the outside of the top 10, from the perspective of FIG. 1. Illustrative, non-exclusive examples of fasteners include (but are not limited to) buttons and button holes or button loops, male and female snaps, hook-and-loop fasteners, clasps, hook-and-bar fasteners, hook-and-eye fasteners, and zippers. Also, in FIG. 1, the fasteners are schematically illustrated extending over the elastic band 16, schematically representing that the one or more such fasteners may be coupled to the elastic band 16 at the respective location along the respective edge or interface.

In some examples of top 10, one or both fastener pairs may comprise two distinct types of corresponding fasteners, with a first type of fastener being positioned above a second type of fastener. In some such examples of top 10, the second type of fastener may coincide with the elastic band 16, while the first type of fastener does not coincide with the elastic band 16, but otherwise spans a substantial height of (i) the inner right edge 54 and inner left interface 58 or (ii) the inner left edge 52 and the inner right interface 60. As an illustrative, non-exclusive example, the first type of fastener may comprise a zipper that extends along substantially all of the corresponding height of (i) the inner right edge 54 and inner left interface 58 or (ii) the inner left edge 52 and the inner right interface 60, while the second type of fastener may comprise a hook-and-eye fastener that coincides with the elastic band 16. In some such examples, the zipper may be configured to zip (i.e., translate or slide) from top to bottom to close the zipper (i.e., to fasten the two halves of the zipper together for donning the top 10) and from bottom to top to open the zipper (i.e., to separate the two halves of the zipper for taking off the top 10). Such a configuration of fastening system 18 may facilitate donning of the top 10, because the second type of fastener (e.g., the hook-and-eye fastener) may first be secured against the tension of the elastic band 16 before the first type of fastener (e.g., the zipper) is operatively fastened. Moreover, use of a zipper as the first type of fastener along a substantial height of the corresponding edge provides for a clean edge when fastened, without the wearer's chest causing regions to buckle or bulge between otherwise spaced-apart fasteners, such as if buttons or other similar fasteners were used.

In some examples of top 10, additional padding may be provided between a fastener and the corresponding fabric panel or the elastic band 16. For example, in the illustrative, non-exclusive example discussed immediately above, padding may be provided that generally coincides with the hook-and-eye fastener, such that when the top 10 is donned, the hook-and-eye fastener does not uncomfortably press against the wearer of the top 10.

Depending on the location of the fasteners, tops 10 may be configured as a right-side out top 96 or as a left-side out top 98. That is, in a right-side out top 96, the at least one right edge fastener 88 is coupled (e.g., sewn) to the right-side front section 46 along the inner right edge 54, the at least one left interface fastener 90 is coupled (e.g., sewn) to the outer fabric layer 12 along the outer left interface 34, the at least one left edge fastener 92 is coupled (e.g., sewn) to the left-side front section 44 along the outer left edge 28, and the at least one right interface fastener 94 is coupled (e.g., sewn) to the inner fabric layer 14 along the inner right interface 60. In some examples of tops 10, while a respective fastener may in fact be coupled (e.g., sewn) to both the outer fabric layer 12 and the inner fabric layer 14, such as to ensure a secure attachment, the structural feature of a respective fastener may be positioned on either the inside or the outside of the top 10, depending on whether the top 10 is a right-side out top 96 or a left-side out top 98. For example, in a right-side out top 96, the structural features of the at least one right edge fastener 88 and the at least one right interface fastener 94 may be positioned on the inside of the right-side out top 96, and the structural features of the left edge fastener 92 and the left interface fastener 90 may be positioned on the outside of the right-side out top 96. In other examples of right-side out tops 96, the structural feature of the at least one right interface fastener 94 is positioned on the inside, the structural feature of the at least one left interface fastener 90 is positioned on the outside, and the structural features of the left edge fastener 92 and the right edge fastener 88 extend outward from the respective edge without necessarily being on one of the inside or the outside of the top 96.

In a left-side out top 98, the at least one right edge fastener 88 is coupled (e.g., sewn) to the right-side front section 46 along the outer right edge 30, the at least one left interface fastener 90 is coupled (e.g., sewn) to the inner fabric layer 14 along the inner left interface 58, the at least one left edge fastener 92 is coupled (e.g., sewn) to the left-side front section 44 along the inner left edge 52, and the at least one right interface fastener 94 is coupled (e.g., sewn) to the outer fabric layer 12 along the outer right interface 36. For example, in a left-side out top 98, the structural features of the at least one right edge fastener 88 and the at least one right interface fastener 94 may be positioned on the outside of the left-side out top 98, and the structural features of the at least one left edge fastener 92 and the at least one left interface fastener 90 may be positioned on the inside of the left-side out top 98. In other examples of left-side out tops 98, the structural feature of the at least one right interface fastener 94 is positioned on the outside, the structural feature of the at least one left interface fastener 90 is positioned on the inside, and the structural features of the left edge fastener 92 and the right edge fastener 88 extend outward from the respective edge without necessarily being on one of the inside or the outside of the top 98.

As mentioned, in some examples of tops 10, only one of the two fastener pairs (i.e., one of (i) the right edge fastener 88 and the left interface fastener 90 and (ii) the left edge fastener 92 and the right interface fastener 94) includes two distinct types of corresponding fasteners, with a first type of fastener being positioned above a second type of fastener, while the other of the two fastener pairs includes only a single type of fastener. In some such examples of tops 10, the fastener pair having two distinct types of fasteners corresponds to the fastener pair that is first secured when the top is being donned. Accordingly, in a right-side out top 96, the left edge fastener 92 and the right interface fastener 94 include two distinct types of corresponding fasteners, and in a left-side out top 98, the right edge fastener 88 and the left interface fastener 90 include two distinct types of corresponding fasteners. Such a configuration of fastening system 18 may facilitate donning of the top 10, because once the initial tension of the elastic band 16 is overcome and the first fastener pair is secured against the wearer's body, the second fastener pair is easier to fasten without needing to initially hold the tension of the elastic band 16. Moreover, the final aesthetics of the donned top 10 may benefit from a single fastener (e.g., a zipper) being used along the entire height of the corresponding edge that is visible when the top 10 is donned by a wearer.

In some examples of tops 10, one or both of outer fabric layer 12 and inner fabric layer 14 may incorporate ruching along one or more of (i) the inner right edge 54 and the outer right edge 30 (optionally only the upper portion thereof that coincides with the inner right edge 54) and, (ii) the inner right interface 60 and the outer right interface 36 (optionally only the upper portion thereof that coincides with the inner right interface 60), (iii) the inner left interface 58 and the outer left interface 34 (optionally only the upper region thereof that coincides with the inner left interface 58), and (iv) the inner left edge 52 and the outer left edge 28 (optionally only the upper portion thereof that coincides with the inner left edge 52). Such a configuration may facilitate appropriate fitting of tops 10 across multiple sizes and shapes of wearers. In addition, such ruching may facilitate the hiding or masking of any bulging or buckling that may occur adjacent to the fastening system 18. In addition, such ruching may provide a desired aesthetic of tops 10.

In some examples of tops 10, the inner left portion 38, the inner right portion 40, the outer left portion 20, and the outer right portion 22 are all free of breast cup structures. In other words, the fabric that defines these portions may be generally free of seams within their interior space, excluding seams along their edges. Additionally, rigid structures, such as wires or other cup-defining structures, may not be present.

In other examples of tops 10, cup-defining structures may be present and may be operatively attached (e.g., sewn) to one or both of the inner left portion 38 and the inner right portion 40 of the inner fabric layer 14. In some such examples, cup-defining structures may be present only on one of the inner left portion 38 and the inner right portion 40 that forms the inside front of the top 10 when the top 10 is donned. That is, in a right-side out top 96, in some examples, such cup-defining structures may be operatively attached only to the inner left portion 38, and in a left-side out top 98, in some examples, such cup-defining structure may be operatively attached only to the inner right portion 40. As an example only, soft cup structures may be included in a swim wear version of a top 10, and/or cup-defining structures may be included in a large-sized version of a top 10.

As schematically and optionally illustrated in FIG. 1 in dash-dot lines, some tops 10 further comprise an elastic strip 76 that extends along the outer upper edge 26 and/or the inner upper edge 50. When present, the elastic strip 76 facilitates the upper edge of the top 10 laying against a wearer's body when the top 10 is sized appropriately and donned, as opposed to, for example, regions of the upper edge of the top 10 buckling or otherwise becoming spaced-away from the wearer's body.

Tops 10 may be particularly well suited and/or specifically configured for use by wearers having relatively large breasts or above-average sized breasts, such as typically sized in the 34DD and larger range. For example, the inner left portion 38 and the inner right portion 40 of the inner fabric layer 14 may be sized and shaped to accommodate above-average sized breasts, with the elastic band 16 being configured to be positioned just inferior to (e.g., lower than, or under) the wearer's breasts while top 10 is worn. In this manner, the inner fabric layer 14 together with the elastic band 16 are configured to substantially contain, or cradle, the wearer's breasts within the fabric of the inner left portion 38 and the inner right portion 40, thereby providing sufficient support such that the wearer may be comfortable without the use of an underlying structured bra or sports bra. That said, tops 10 are not limited to being configured for use by wearers having relatively large breasts or above-average sized breasts, such as typically sized in the 34DD and larger range, and tops 10 may be configured for use by wearers having smaller chest/breast sizes including as small as or smaller than 30D.

Tops 10 may be sized and sold according to band sizes, such as corresponding to a standard chest measurement directly below the bust of a wearer. Such band size may correspond, or approximately correspond, to a length of the elastic band 16 when comfortably stretched around a wearer's chest. Additionally or alternatively, such band size may correspond, or approximately correspond, to maximum inner width 72 of inner fabric layer 14. Accordingly, tops 10 may be sized and sold according to a single number, with which wearers typically are familiar, such as corresponding to the band size number of typical bra sizing (e.g., 30, 32, 34, 36, 38, or 40 inches).

Turning now to FIGS. 2-6, an illustrative non-exclusive example of top 10 is illustrated and referred to herein as top 100. Where appropriate, the reference numerals from the schematic illustration of FIG. 1 are used to designate corresponding parts of top 100; however, top 100 is non-exclusive and does not limit tops 10 to the illustrated embodiment of FIGS. 2-6. That is, tops 10 are not limited to the specific embodiment of top 100, and tops 10 may incorporate any number of the various aspects, configurations, characteristics, properties, etc. of tops 10 that are illustrated in and discussed with reference to the schematic representation of FIG. 1 and/or the embodiment of FIGS. 2-6, as well as variations thereof, without requiring the inclusion of all such aspects, configurations, characteristics, properties, etc. For the purpose of brevity, each previously discussed component, part, portion, aspect, region, etc. or variants thereof may not be discussed, illustrated, and/or labeled again with respect to top 100; however, it is within the scope of the present disclosure that the previously discussed features, variants, etc. may be utilized with top 100.

Top 100 is an example of a left-side out top 98, in which the outer fabric layer 14 extends below the inner fabric layer 12, such as to cover the lower torso and abdomen of a wearer when the top 100 is worn.

Figure 2:
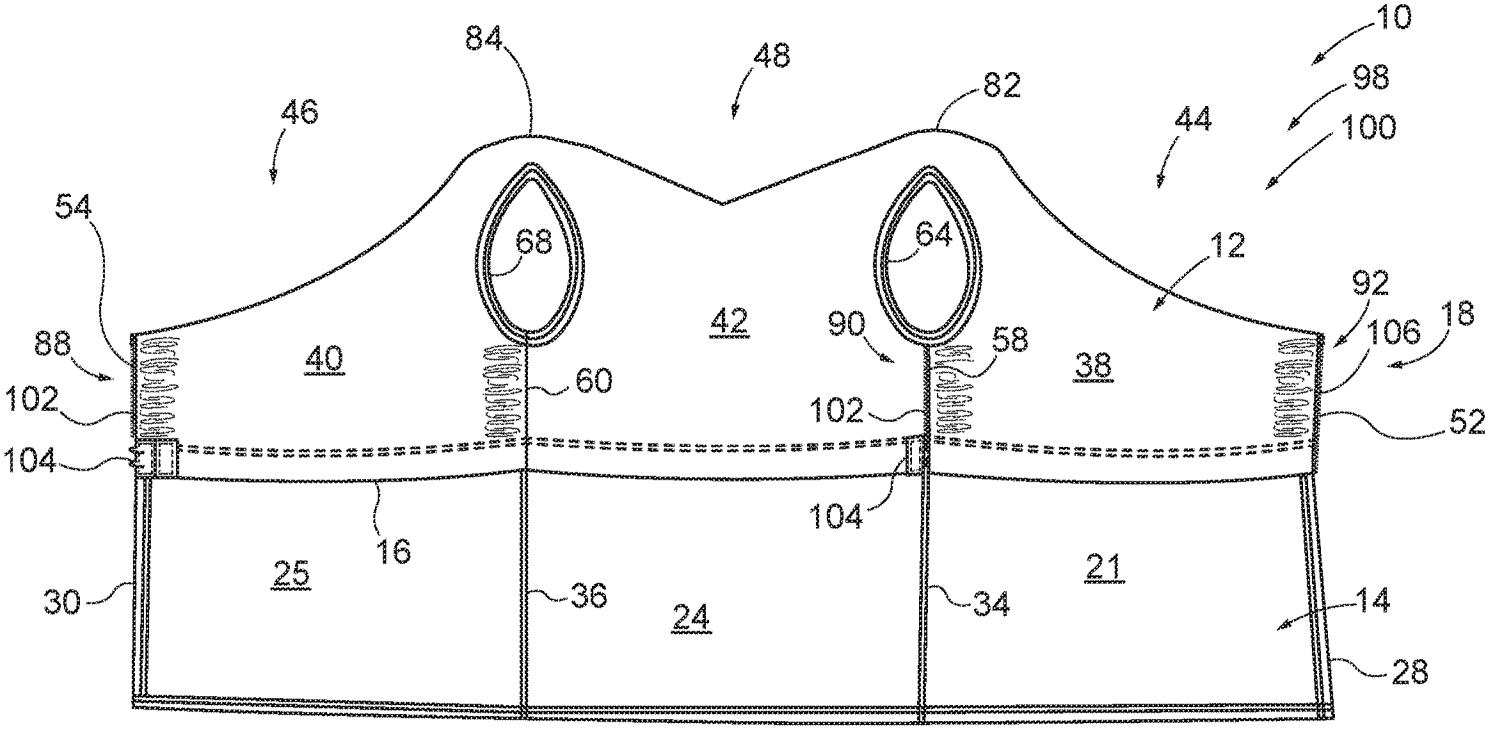
FIG. 2 is an open plan view of an illustrative, non-exclusive example of a left-side out wrap-style breast-supportive top according to the present disclosure.
Figure 3:
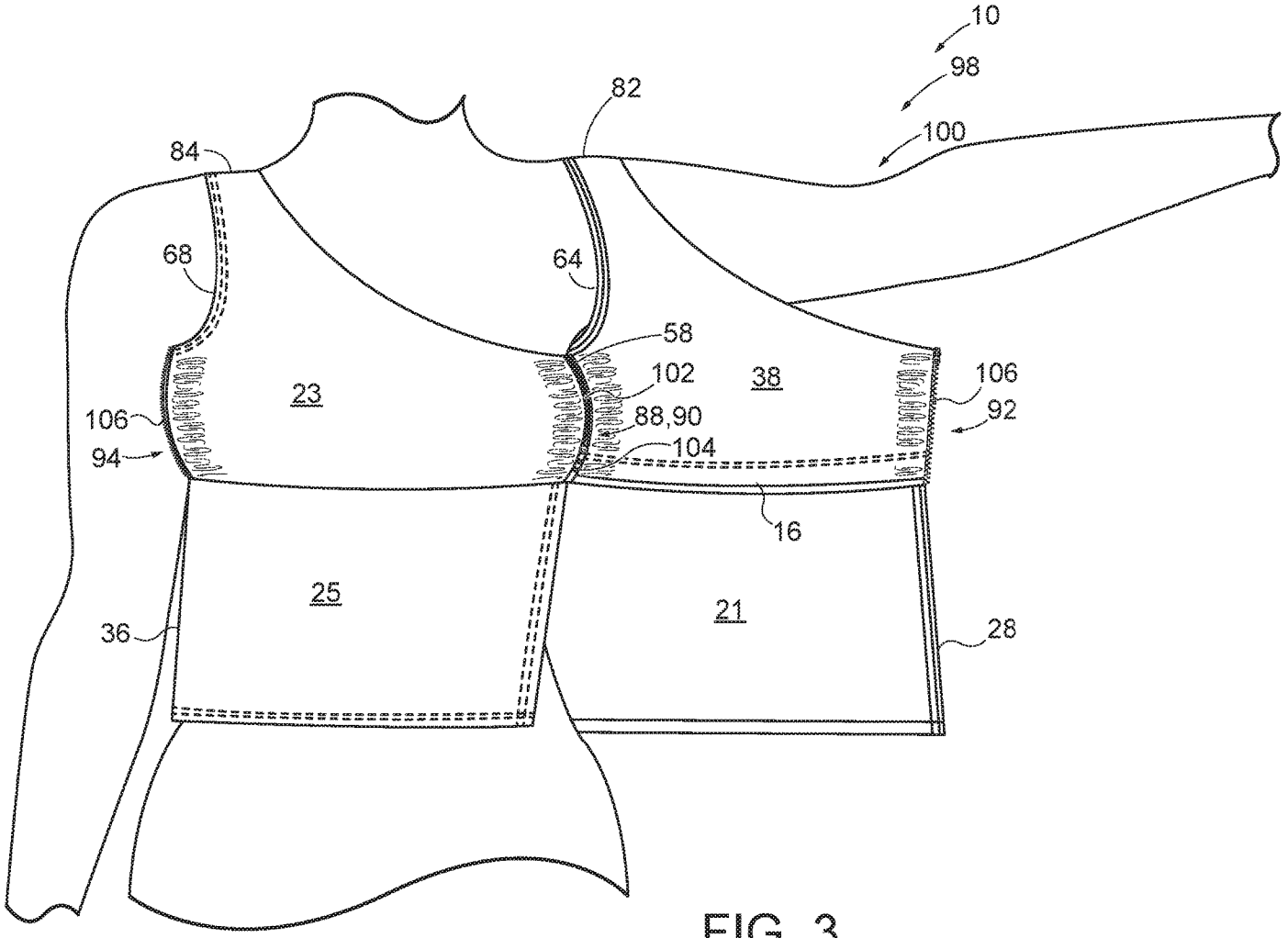
FIG. 3 is a front view of the example wrap-style breast-supportive top of FIG. 2, being donned by a wearer.

In addition, top 100 is an example of a top 10 that includes two distinct types of fasteners associated with the fastener pair that is first fastened when the top 100 is being donned. More specifically, as seen in FIGS. 2 and 3, the at least one right edge fastener 88 and the at least one left interface fastener 90 comprise an upper zipper pair 102 and a lower hook-and-eye fastener pair 104. In contrast, as seen in FIGS. 2-4, the at least one left edge fastener 92 and the at least one right interface fastener 94 comprise a single zipper pair 106.

Figure 4:
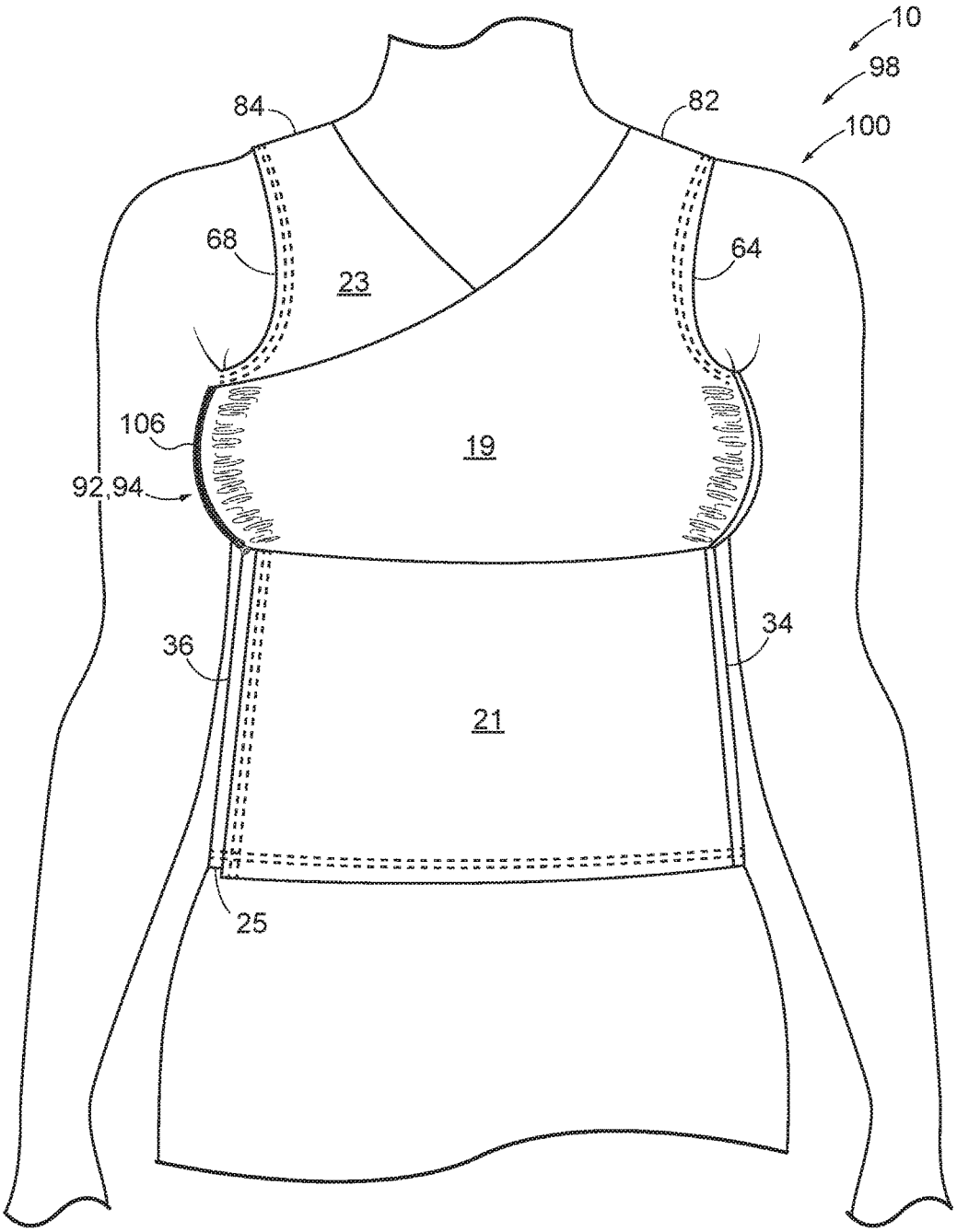
FIG. 4 is a front view of the example wrap-style breast-supportive top of FIG. 2, donned by a wearer.
Figure 5:
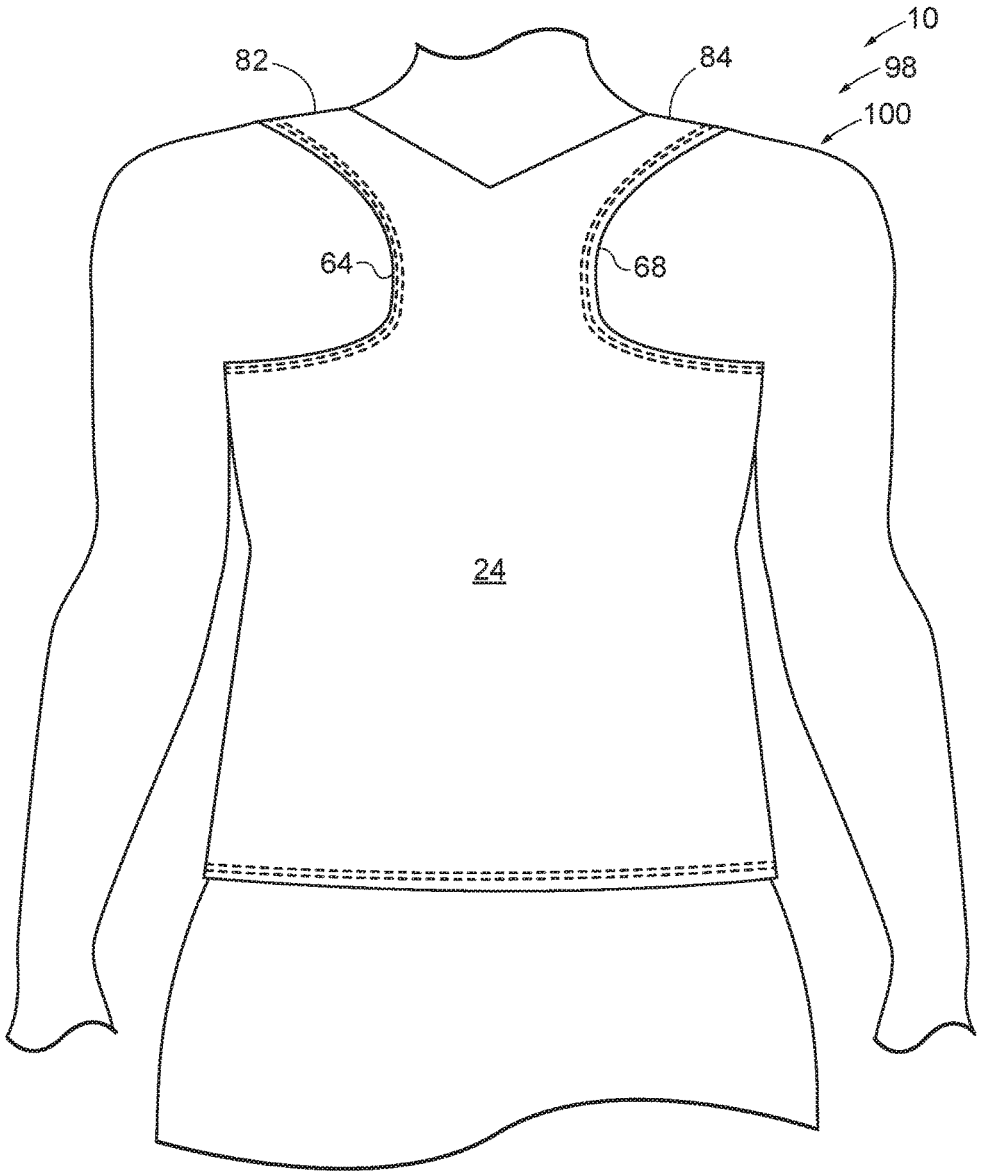
FIG. 5 is a rear view of the example wrap-style breast-supportive top of FIG. 2, donned by a wearer.
Figure 6:
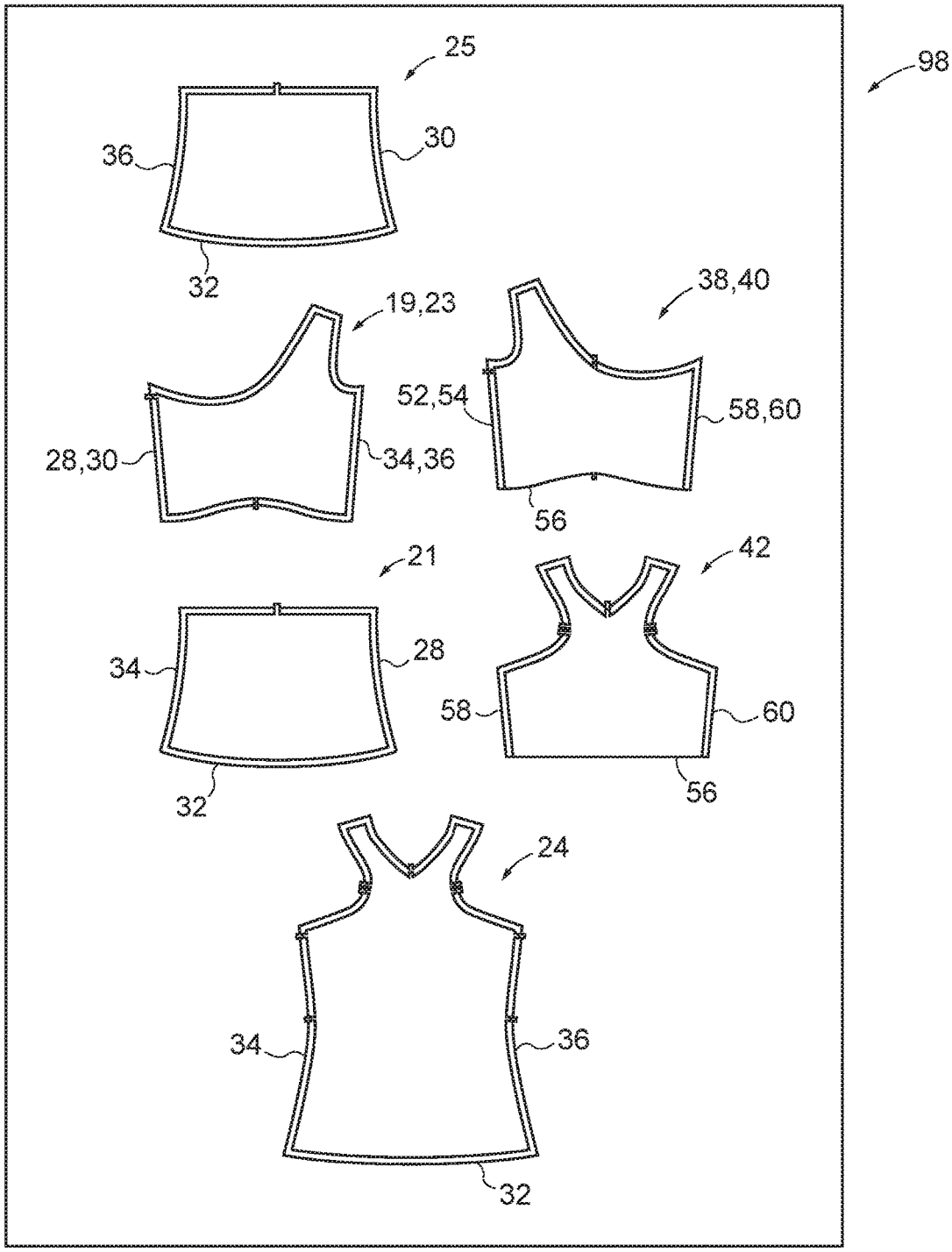
FIG. 6 is a plan view of a pattern for the example wrap-style breast-supportive top of FIG. 2.

As seen in FIGS. 3 and 4, and also with reference to FIG. 6, top 100 is an example of a top 10 in which the outer left portion 20 is constructed from an upper outer left panel 19 and a lower outer left panel 21, and in which the outer right portion 22 is constructed of an upper outer right panel 23 and a lower outer right panel 25. The outer central panel 24, however, is constructed of a single panel of fabric, as seen in FIGS. 5 and 6.

As seen in FIGS. 2-4, top 100 is an example of a top 10 that includes ruching along the inner right edge 54 and the inner right interface 60 of the inner right portion 40, together with ruching along the coinciding outer right edge 30 and the outer right interface 36 of the upper outer right panel 23. Similarly, top 100 includes ruching along the inner left edge 52 and the inner left interface 58 of the inner left portion 38, together with ruching along the coinciding outer left edge 28 and the outer left interface 34 of the upper outer left panel 19. With reference to FIG. 6, to account for the ruching, each of the upper outer left panel 19, the upper outer right panel 23, the inner left portion 38, and the inner right portion 40 has a concave up lower edge to account for the respective left and right edges and interfaces needing extra material for the ruching.

With reference to FIG. 5, top 100 may be described as having a racerback to provide ease of movement of a wearer's shoulder blades when the top 100 is donned.

Illustrative, non-exclusive examples of inventive subject matter according to the present disclosure are described in the following enumerated paragraphs:

A. A wrap-style breast-supportive top, comprising (optionally consisting of, optionally consisting essentially of):

an outer fabric layer, wherein:

the outer fabric layer has an outer left portion, an outer right portion, and an outer central portion that is positioned between the outer left portion and the outer right portion, and the outer fabric layer has an outer upper edge, an outer left edge, an outer right edge, an outer lower edge, an outer left interface between the outer left portion and the outer central portion, and an outer right interface between the outer right portion and the outer central portion;

an inner fabric layer coupled to the outer fabric layer, wherein:

the inner fabric layer is positioned to be between the outer fabric layer and a wearer when the wearer is wearing the wrap-style breast-supportive top, the inner fabric layer has an inner left portion that overlaps an upper region of the outer left portion to collectively define a left-side front section, an inner right portion that overlaps an upper region of the outer right portion to collectively define a right-side front section, and an inner central portion that is positioned between the inner left portion and the inner right portion and that overlaps an upper region of the outer central portion to collectively define a back section, the inner fabric layer has an inner upper edge that is coupled (e.g., sewn) to the outer upper edge, an inner left edge that is coupled (e.g., sewn) to the outer left edge, an inner right edge that is coupled (e.g., sewn) to the outer right edge, an inner lower edge, an inner left interface between the inner left portion and the inner central portion, and an inner right interface between the inner right portion and the inner central portion, the left-side front section and the back section collectively define a left armscye or a left arm hole along the outer left interface and the inner left interface, and the right-side front section and the back section collectively define a right armscye or a right arm hole along the outer right interface and the inner right interface; and a fastening system comprising:

at least one right edge fastener coupled (e.g., sewn) to the right-side front section along the inner right edge and/or the outer right edge;

at least one left interface fastener coupled (e.g., sewn) to the outer fabric layer and/or the inner fabric layer along the outer left interface and/or the inner left interface, wherein the at least one left interface fastener is configured to be selectively coupled to and decoupled from the at least one right edge fastener;

at least one left edge fastener coupled (e.g., sewn) to the left-side front section along the inner left edge and/or the outer left edge; and at least one right interface fastener coupled (e.g., sewn) to the outer fabric layer and/or the inner fabric layer along the outer right interface and/or the inner right interface, wherein the at least one right interface fastener is configured to be selectively coupled to and decoupled from the at least one left edge fastener.

A1. The wrap-style breast-supportive top of paragraph A, wherein:

the at least one right edge fastener is coupled (e.g., sewn) to the right-side front section along the inner right edge;

the at least one left interface fastener is coupled (e.g., sewn) to the outer fabric layer along the outer left interface;

the at least one left edge fastener is coupled (e.g., sewn) to the left-side front section along the outer left edge; and the at least one right interface fastener is coupled (e.g., sewn) to the inner fabric layer along the inner right interface.

A1.1. The wrap-style breast-supportive top of paragraph A1, wherein:

the at least one right edge fastener and the at least one left interface fastener consist of a single fastener pair; and the at least one left edge fastener and the at least one right interface fastener consist of two fastener pairs.

A1.1.1. The wrap-style breast-supportive top of paragraph A1.1, wherein the two fastener pairs consist of an upper zipper pair and a lower fastener pair, and wherein the lower fastener pair is not a zipper pair.

A2. The wrap-style breast-supportive top of paragraph A, wherein:

the at least one right edge fastener is coupled (e.g., sewn) to the right-side front section along the outer right edge;

the at least one left interface fastener is coupled (e.g., sewn) to the inner fabric layer along the inner left interface;

the at least one left edge fastener is coupled (e.g., sewn) to the left-side front section along the inner left edge; and the at least one right interface fastener is coupled (e.g., sewn) to the outer fabric layer along the outer right interface.

A2.1. The wrap-style breast-supportive top of paragraph A2, wherein:

the at least one left edge fastener and the at least one right interface fastener consist of a single fastener pair; and the at least one right edge fastener and the at least one left interface fastener consist of two fastener pairs.

A2.1.1. The wrap-style breast-supportive top of paragraph A2.1, wherein:

the two fastener pairs consist of an upper zipper pair and a lower fastener pair; and the lower fastener pair is not a zipper pair.

A3. The wrap-style breast-supportive top of any of paragraphs A-A2.1.1, wherein:

the outer left interface and the inner left interface are coupled (e.g., sewn) together; and the outer right interface and the inner right interface are coupled (e.g., sewn) together.

A4. The wrap-style breast-supportive top of any of paragraphs A-A3, wherein one or more of the outer left portion, the outer right portion, the outer central portion, the inner left portion, the inner right portion, and the inner central portion are each constructed of a discrete panel of fabric.

A5. The wrap-style breast-supportive top of any of paragraphs A-A4, wherein one or more of:

the outer left portion is coupled (e.g., sewn) to the outer central portion along the outer left interface;

the outer right portion is coupled (e.g., sewn) to the outer central portion along the outer right interface;

the inner left portion is coupled (e.g., sewn) to the inner central portion along the inner left interface; and the inner right portion is coupled (e.g., sewn) to the inner central portion along the inner right interface.

A6. The wrap-style breast-supportive top of any of paragraphs A-A5, wherein the outer left edge is longer than the inner left edge, the outer right edge is longer than the inner right edge, the outer left interface is longer than the inner left interface, and the outer right interface is longer than the inner right interface, so that the outer fabric layer hangs below the inner lower edge.

A7. The wrap-style breast-supportive top of any of paragraphs A-A6, wherein the outer left edge is at least twice as long as the inner left edge, and the outer right edge is at least twice as long as the inner right edge.

A8. The wrap-style breast-supportive top of any of paragraphs A-A7, further comprising: an elastic band coupled (e.g., sewn) to the inner fabric layer along the inner lower edge.

A8.1. The wrap-style breast-supportive top of paragraph A8, wherein the elastic band is not coupled directly to the outer fabric layer other than optionally at one or more of the outer left interface, the outer right interface, the outer left edge, and the outer right edge.

A9. The wrap-style breast-supportive top of any of paragraphs A-A8.1, wherein:

the outer fabric layer has a maximum outer width that extends from the outer left edge to the outer right edge;

the inner fabric layer has a maximum inner width that extends from the inner left edge to the inner right edge; and the inner lower edge has a relaxed length when a tensile force is not applied along the inner lower edge.

A9.1. The wrap-style breast-supportive top of paragraph A9, wherein the relaxed length is less than the maximum outer width, optionally wherein the relaxed length is one or more of 50-90%, 60-90%, and 70-90% of the maximum outer width.

A9.2. The wrap-style breast-supportive top of any of paragraphs A9-A9.1, wherein the relaxed length is less than the maximum inner width, optionally wherein the relaxed length is one or more of 50-90%, 60-90%, and 70-90% of the maximum inner width.

A9.3. The wrap-style breast-supportive top of any of paragraphs A9-A9.2, wherein the maximum outer width is equal to or approximately equal to the maximum inner width.

A10. The wrap-style breast-supportive top of any of paragraphs A-A9.3, wherein:

the outer fabric layer and the inner fabric layer collectively define a left shoulder strap and a right shoulder strap that extend over the wearer's shoulders when the wearer is wearing the wrap-style breast-supportive top; and the left shoulder strap and the right shoulder strap each have a minimum width of no less than 1, 1.5, or 2 inches.

A11. The wrap-style breast-supportive top of any of paragraphs A-A10, wherein the inner left portion, the inner right portion, the outer left portion, and the outer right portion are all free of breast cup structures.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

As used herein, the term "and/or" placed between a first entity and a second entity means one of (1) the first entity, (2) the second entity, and (3) the first entity and the second entity. Multiple entries listed with "and/or" should be construed in the same manner, i.e., "one or more" of the entities so conjoined. Other entities optionally may be present other than the entities specifically identified by the "and/or" clause, whether related or unrelated to those entities specifically identified. Thus, as a non-limiting example, a reference to "A and/or B," when used in conjunction with open-ended language such as "comprising," may refer, in one example, to A only (optionally including entities other than B); in another example, to B only (optionally including entities other than A); in yet another example, to both A and B (optionally including other entities). These entities may refer to elements, actions, structures, steps, operations, values, and the like.

The various disclosed elements of apparatuses disclosed herein are not required to all apparatuses according to the present disclosure, and the present disclosure includes all novel and non-obvious combinations and subcombinations of the various elements disclosed herein. Moreover, one or more of the various elements disclosed herein may define independent inventive subject matter that is separate and apart from the whole of a disclosed apparatus. Accordingly, such inventive subject matter is not required to be associated with the specific apparatuses that are expressly disclosed herein, and such inventive subject matter may find utility in apparatuses that are not expressly disclosed herein.

The invention claimed is:

1. A wrap-style breast-supportive top, comprising:

an outer fabric layer, wherein:

the outer fabric layer has an outer left portion, an outer right portion, and an outer central portion that is positioned between the outer left portion and the outer right portion, and the outer fabric layer has an outer upper edge, an outer left edge, an outer right edge, an outer lower edge, an outer left interface between the outer left portion and the outer central portion, and an outer right interface between the outer right portion and the outer central portion;

an inner fabric layer coupled to the outer fabric layer, wherein:

the inner fabric layer is positioned to be between the outer fabric layer and a wearer when the wearer is wearing the wrap-style breast-supportive top, the inner fabric layer has an inner left portion that overlaps an upper region of the outer left portion to collectively define a left-side front section, an inner right portion that overlaps an upper region of the outer right portion to collectively define a right-side front section, and an inner central portion that is positioned between the inner left portion and the inner right portion and that overlaps an upper region of the outer central portion to collectively define a back section, the inner fabric layer has an inner upper edge that is aligned with and continuously coupled along the outer upper edge, an inner left edge that is coupled to the outer left edge, an inner right edge that is coupled to the outer right edge, an inner lower edge, an inner left interface between the inner left portion and the inner central portion, and an inner right interface between the inner right portion and the inner central portion, the left-side front section and the back section collectively define a left armscye or a left arm hole along the outer left interface and the inner left interface, and the right-side front section and the back section collectively define a right armscye or a right arm hole along the outer right interface and the inner right interface; and a fastening system comprising:

at least one right edge fastener coupled to the right-side front section along the inner right edge and/or the outer right edge above the inner lower edge;

at least one left interface fastener coupled to the outer fabric layer and/or the inner fabric layer along the outer left interface and/or the inner left interface above the inner lower edge, wherein the at least one left interface fastener is configured to be selectively coupled to and decoupled from the at least one right edge fastener;

at least one left edge fastener coupled to the left-side front section along the inner left edge and/or the outer left edge above the inner lower edge; and at least one right interface fastener coupled to the outer fabric layer and/or the inner fabric layer along the outer right interface and/or the inner right interface above the inner lower edge, wherein the at least one right interface fastener is configured to be selectively coupled to and decoupled from the at least one left edge fastener.

2. The wrap-style breast-supportive top of claim 1, wherein:

the at least one right edge fastener is coupled to the right-side front section along the inner right edge;

the at least one left interface fastener is coupled to the outer fabric layer along the outer left interface;

the at least one left edge fastener is coupled to the left-side front section along the outer left edge; and the at least one right interface fastener is coupled to the inner fabric layer along the inner right interface.

3. The wrap-style breast-supportive top of claim 2, wherein:

the at least one right edge fastener and the at least one left interface fastener consist of a single fastener pair; and the at least one left edge fastener and the at least one right interface fastener consist of two fastener pairs.

4. The wrap-style breast-supportive top of claim 3, wherein:

the two fastener pairs consist of an upper zipper pair and a lower fastener pair; and the lower fastener pair is not a zipper pair.

5. The wrap-style breast-supportive top of claim 1, wherein:

the at least one right edge fastener is coupled to the right-side front section along the outer right edge;

the at least one left interface fastener is coupled to the inner fabric layer along the inner left interface;

the at least one left edge fastener is coupled to the left-side front section along the inner left edge; and the at least one right interface fastener is coupled to the outer fabric layer along the outer right interface.

6. The wrap-style breast-supportive top of claim 5, wherein:

the at least one left edge fastener and the at least one right interface fastener consist of a single fastener pair; and the at least one right edge fastener and the at least one left interface fastener consist of two fastener pairs.

7. The wrap-style breast-supportive top of claim 6, wherein:

the two fastener pairs consist of an upper zipper pair and a lower fastener pair; and the lower fastener pair is not a zipper pair.

8. The wrap-style breast-supportive top of claim 1, wherein:

the outer left interface and the inner left interface are coupled together; and the outer right interface and the inner right interface are coupled together.

9. The wrap-style breast-supportive top of claim 1, wherein the outer left edge is longer than the inner left edge, the outer right edge is longer than the inner right edge, the outer left interface is longer than the inner left interface, and the outer right interface is longer than the inner right interface, so that the outer fabric layer hangs below the inner lower edge.

10. The wrap-style breast-supportive top of claim 1, wherein the outer left edge is at least twice as long as the inner left edge, and the outer right edge is at least twice as long as the inner right edge.

11. The wrap-style breast-supportive top of claim 1, further comprising:

an elastic band coupled to the inner fabric layer along the inner lower edge.

12. The wrap-style breast-supportive top of claim 11, wherein the elastic band is not coupled directly to the outer fabric layer other than at the outer left interface, the outer right interface, the outer left edge, and the outer right edge.

13. The wrap-style breast-supportive top of claim 1, wherein:

the outer fabric layer has a maximum outer width that extends from the outer left edge to the outer right edge;

the inner fabric layer has a maximum inner width that extends from the inner left edge to the inner right edge;

the inner lower edge has a relaxed length when a tensile force is not applied along the inner lower edge; and the relaxed length is less than the maximum outer width.

14. The wrap-style breast-supportive top of claim 13, wherein the maximum outer width is equal to or approximately equal to the maximum inner width.

15. The wrap-style breast-supportive top of claim 1, wherein:

the outer fabric layer and the inner fabric layer collectively define a left shoulder strap and a right shoulder strap that extend over the wearer's shoulders when the wearer is wearing the wrap-style breast-supportive top; and the left shoulder strap and the right shoulder strap each have a minimum width of no less than 1 inch.

16. The wrap-style breast-supportive top of claim 1, wherein the inner left portion, the inner right portion, the outer left portion, and the outer right portion are ail free of breast cup structures.

17. A wrap-style breast-supportive top, comprising:

an outer fabric layer, wherein:

the outer fabric layer has an outer left portion, an outer right portion, and an outer central portion that is positioned between the outer left portion and the outer right portion, and the outer fabric layer has an outer upper edge, an outer left edge, an outer right edge, an outer lower edge, an outer left interface between the outer left portion and the outer central portion, and an outer right interface between the outer right portion and the outer central portion;

an inner fabric layer coupled to the outer fabric layer, wherein:

the inner fabric layer is positioned to be between the outer fabric layer and a wearer when the wearer is wearing the wrap-style breast-supportive top, the inner fabric layer has an inner left portion that overlaps an upper region of the outer left portion to collectively define a left-side front section, an inner right portion that overlaps an upper region of the outer right portion to collectively define a right-side front section, and an inner central portion that is positioned between the inner left portion and the inner right portion and that overlaps an upper region of the outer central portion to collectively define a back section, the inner fabric layer has an inner upper edge that is aligned with and continuously coupled along the outer upper edge, an inner left edge that is coupled to the outer left edge, an inner right edge that is coupled to the outer right edge, an inner lower edge, an inner left interface between the inner left portion and the inner central portion, and an inner right interface between the inner right portion and the inner central portion, the left-side front section and the back section collectively define a left armscye or a left arm hole along the outer left interface and the inner left interface, and the right-side front section and the back section collectively define a right armscye or a right arm hole along the outer right interface and the inner right interface;

an elastic band coupled to the inner fabric layer along the inner lower edge; and a fastening system comprising:

at least one right edge fastener;

at least one left interface fastener configured to be selectively coupled to and decoupled from the at least one right edge fastener;

at least one left edge fastener; and at least one right interface fastener configured to be selectively coupled to and decoupled from the at least one left edge fastener;

wherein:

(A) the at least one right edge fastener is coupled to the right-side front section along the inner right edge above the inner lower edge; the at least one left interface fastener is coupled to the outer fabric layer along the outer left interface above the inner lower edge; the at least one left edge fastener is coupled to the left-side front section along the outer left edge above the inner lower edge; the at least one right interface fastener is coupled to the inner fabric layer along the inner right interface above the inner lower edge; the at least one right edge fastener and the at least one left interface fastener consist of a single fastener pair; and the at least one left edge fastener and the at least one right interface fastener consist of two fastener pairs; or (B) the at least one right edge fastener is coupled to the right-side front section along the outer right edge above the inner lower edge; the at least one left interface fastener is coupled to the inner fabric layer along the inner left interface above the inner lower edge; the at least one left edge fastener is coupled to the left-side front section along the inner left edge above the inner lower edge; the at least one right interface fastener is coupled to the outer fabric layer along the outer right interface above the inner lower edge; the at least one left edge fastener and the at least one right interface fastener consist of a single fastener pair; and the at least one right edge fastener and the at least one left interface fastener consist of two fastener pairs.

18. The wrap-style breast-supportive top of claim 17, wherein:

the two fastener pairs consist of an upper zipper pair and a lower fastener pair; and the lower fastener pair is not a zipper pair.

19. A wrap-style breast-supportive top, comprising:

an outer fabric layer, wherein:

the outer fabric layer has an outer left portion, an outer right portion, and an outer central portion that is positioned between the outer left portion and the outer right portion, and the outer fabric layer has an outer upper edge, an outer left edge, an outer right edge, an outer lower edge, an outer left interface between the outer left portion and the outer central portion, and an outer right interface between the outer right portion and the outer central portion;

an inner fabric layer coupled to the outer fabric layer, wherein:

the inner fabric layer is positioned to be between the outer fabric layer and a wearer when the wearer is wearing the wrap-style breast-supportive top, the inner fabric layer has an inner left portion that overlaps an upper region of the outer left portion to collectively define a left-side front sections, an inner right portion that overlaps an upper region of the outer right portion to collectively define a right-side front section, and an inner central portion that is positioned between the inner left portion and the inner right portion and that overlaps an upper region of the outer central portion to collectively define a back section, the inner fabric layer has an inner upper edge that is aligned with and continuously coupled along the outer upper edge, an inner left edge that is coupled to the outer left edge, an inner right edge that is coupled to the outer right edge, an inner lower edge, an inner left interface between the inner left portion and the inner central portion, and an inner right interface between the inner right portion and the inner central portion, the left-side front section and the back section collectively define a left armscye or a left arm hole along the outer left interface and the inner left interface, and the right-side front section and the back section collectively define a right armscye or a right arm hole along the outer right interface and the inner right interface;

an elastic band coupled to the inner fabric layer along the inner lower edge;

means for fastening the inner left edge adjacent to the inner right interface; and means for fastening the inner right edge adjacent to the inner left interface.

20. The wrap-style breast-supportive top of claim 19, wherein:

one of the means for fastening the inner left edge adjacent to the inner right interface and the means for fastening the inner right edge adjacent to the inner left interface consists of two fastener pairs; and the other of the means for fastening the inner left edge adjacent to the inner right interface and the means for fastening the inner right edge adjacent to the inner left interface consists of a single fastener pair.

* * * * *